US009708162B2

(12) United States Patent
Fry

(10) Patent No.: US 9,708,162 B2
(45) Date of Patent: Jul. 18, 2017

(54) APPARATUS FOR ASCENDING AND DESCENDING STAIRS WITH A WHEELCHAIR

(71) Applicant: Dwight Fry, Victoria (CA)

(72) Inventor: Dwight Fry, Victoria (CA)

( * ) Notice: Subject to any disclaimer, the term of this patent is extended or adjusted under 35 U.S.C. 154(b) by 553 days.

(21) Appl. No.: 14/354,511

(22) PCT Filed: Nov. 7, 2012

(86) PCT No.: PCT/CA2012/001025
§ 371 (c)(1),
(2) Date: Apr. 25, 2014

(87) PCT Pub. No.: WO2013/067623
PCT Pub. Date: May 16, 2013

(65) Prior Publication Data

US 2014/0251733 A1 Sep. 11, 2014

(30) Foreign Application Priority Data

Nov. 8, 2011 (CA) ..... 2757551

(51) Int. Cl.
*B66B 9/08* (2006.01)
*B66B 9/193* (2006.01)
*A61G 3/06* (2006.01)

(52) U.S. Cl.
CPC ..... *B66B 9/0853* (2013.01); *A61G 3/063* (2013.01); *B66B 9/0823* (2013.01); *B66B 9/0846* (2013.01)

(58) Field of Classification Search
CPC ..... B66B 9/08; B66B 9/083; B66B 9/0823; B66B 9/0853; A61G 5/06; A61G 5/061; A61G 3/063
See application file for complete search history.

(56) References Cited

U.S. PATENT DOCUMENTS 4,050,546 A 9/1977 Wilson
4,155,468 A * 5/1979 Royce ..... B60P 1/4407 14/71.3
4,180,366 A * 12/1979 Roth ..... B60P 1/4457 105/447
4,438,830 A 3/1984 Born
5,050,708 A 9/1991 Wood
(Continued)

FOREIGN PATENT DOCUMENTS

DE 3106316 A1 9/1982
DE 10255516 A1 * 6/2004 ..... A61G 3/06
(Continued)

OTHER PUBLICATIONS

AIPN Machine Translation, JP 2009-101095 A, Sep. 24, 2016, pp. 1-12.*

*Primary Examiner* — William A Rivera
*Assistant Examiner* — Stefan Kruer
(74) *Attorney, Agent, or Firm* — Tomlinson McKinstry, P.C.

(57) ABSTRACT

An apparatus that permits a wheelchair to traverse stairs. A carriage platform supporting the wheelchair is housed in an inclined ways assembly and moves by means of a rotated threaded rod supported in the ways and traveling nuts fixed to the carriage; a debarkation ramp hinged to the carriage, spans the distance and elevation difference between the carriage and the desired landing point.

15 Claims, 23 Drawing Sheets

(56) References Cited

U.S. PATENT DOCUMENTS

| | | | | | |
|---|---|---|---|---|---|
| 5,316,432 | A * | 5/1994 | Smalley | B60R 3/02 | 187/200 |
| 5,463,961 | A * | 11/1995 | Graves | B61C 13/04 | 104/139 |
| 5,553,548 | A | 9/1996 | Eaton | | |
| 5,553,990 | A * | 9/1996 | Kytola, Sr. | B66B 9/04 | 182/146 |
| 5,947,231 | A * | 9/1999 | Raab | A61G 3/063 | 187/200 |
| 6,105,726 | A * | 8/2000 | Taylor | B66B 9/0838 | 187/201 |
| 6,854,147 | B1 * | 2/2005 | Ahlsten | B64D 9/00 | 14/69.5 |
| 7,395,900 | B2 * | 7/2008 | Murray | B66B 9/0869 | 187/200 |
| 8,146,713 | B2 * | 4/2012 | Rosenthal | B66B 9/083 | 187/200 |

FOREIGN PATENT DOCUMENTS

| | | | | |
|---|---|---|---|---|
| DE | 102004002095 | A1 * | 8/2005 | E04F 11/002 |
| EP | 0047574 | A1 | 3/1982 | |
| FR | 2571036 | A | 4/1984 | |
| JP | 57156985 | A | 9/1982 | |
| JP | 1133886 | A | 5/1989 | |
| JP | 7187547 | A | 7/1995 | |
| JP | EP 0982259 | A2 * | 3/2000 | B66B 9/0815 |
| JP | 2000143200 | A | 5/2000 | |
| JP | 2003321173 | A | 11/2003 | |
| JP | 2003335480 | A | 11/2003 | |
| JP | 2005112620 | A | 4/2005 | |
| JP | 2009101095 | A | 5/2009 | |
| NO | WO 9719887 | A1 * | 6/1997 | B64F 1/315 |

* cited by examiner

APPARATUS FOR ASCENDING AND DESCENDING STAIRS WITH A WHEELCHAIR

FIELD OF THE INVENTION

This invention is in the field of devices for assisting the disabled, and relates primarily to assisting wheelchair-bound persons to ascend and descend stairs.

BACKGROUND OF THE INVENTION

With an aging population and a resulting increase in the relative proportion of persons having issues with mobility who require the use of a wheelchair, there is a need for devices that assist such persons to continue to live in their homes, including assisting them to navigate stairs.

Various devices are known for use in moving persons in wheelchairs up and down interior stairs. For example, U.S. Pat. No. 4,345,669 (24 Aug. 1982; Wheelchair Lift; Noall), discloses such a device.

Such devices are not normally used to deal with external stairs. Rather, it is usual to retro-fit a permanent or semi-permanent ramp to enable the wheelchair user to bypass the stairs. However, such fixed ramps must have a gentle slope and thus require considerable space and material. A maximum slope of 1:12 is recommend for exterior wheelchair ramps. Thus, each one-foot rise requires twelve feet of run in order to provide the desired maximum slope. In many situations, there is inadequate room for a ramp with the desired maximum slope.

SUMMARY OF THE INVENTION

In one aspect, the present invention provides a device that permits a wheelchair to traverse stairs. A carriage supporting the wheelchair is housed in an inclined ways assembly and moves by means of a rotated coil rod supported in the ways and traveling nuts fixed to the carriage; a debarkation ramp hinged to the carriage bridges the distance and elevation difference between the carriage and the desired landing point.

In another aspect, the present invention provides an apparatus for use in transporting a wheelchair up or down a set of stairs, the apparatus including: a longitudinally extending ways assembly, having a lower end and an upper end; a wheelchair platform supported by the ways assembly; a motive arrangement for selectively moving the wheelchair platform along the length of the ways assembly between a top position in which a wheelchair may move substantially directly between the wheelchair platform and the top of the stairs and a bottom position; and a ramp having a proximal end and a distal end, the proximal end hingedly attached to the wheelchair platform and the distal end having a ground engagement feature, wherein contact between the ground engagement feature and the ground as the wheelchair platform moves towards the bottom position, causes the ramp to pivot away from the ways assembly so as to provide a wheelchair path of travel between the wheelchair platform and the ground when the wheelchair platform is in the bottom position, and movement of the wheelchair platform towards the top position permits the ramp to pivot towards the ways assembly.

The motive arrangement may include a threaded rod rotatably mounted to the ways assembly and a primary traveling nut threadedly engaging the threaded rod attached to a traveling member, wherein rotation of the threaded rod causes the traveling member to move along the length of the ways assembly.

The wheelchair platform may include a carriage frame having a base affixed to the traveling member and extending along the length of the ways assembly so as to provide support for a wheelchair. The apparatus may also include a secondary nut threadedly engaged with the threaded rod and affixed to the carriage frame in a spaced apart relationship from the primary traveling nut.

The ways assembly may include two opposed side walls, wherein each side wall has a longitudinally extending channel; and wherein the wheelchair platform includes: a plate having a proximal edge and a distal edge, and attached in the vicinity of the proximal edge to the traveling member and hingedly attached at the distal edge to the ramp; and two rollers, each roller engaging a respective channel, wherein the wheelchair platform is supported by the traveling member and the channels. The position of the rollers may be adjustable.

The apparatus may include a motor attached to the threaded rod and configured for selectively reversibly rotating the threaded rod.

The apparatus may include a removeable adapter for connecting a hand-operated reversible power drill to an end of the threaded rod.

The apparatus may include a manual implement for removably connecting to an end of the threaded rod for manually rotating the threaded rod. The manual implement may be a hand wheel.

The ground engagement feature may include two wheels spaced apart one from the other. The ramp may have side rails.

The ramp may be hingedly attached to the wheelchair platform by a hinge having a reversibly retractable hinge pin whereby a user may detach the ramp from the wheelchair platform by manual withdrawal of the hinge pin and may attach the ramp to the wheelchair platform by manual insertion of the hinge pin.

The apparatus may include means for stabilizing the apparatus at a desired position relative to the stairs. The stabilizing means may include a stair foot for fixing at a desired position interposed between the ways assembly and a tread of the stairs. The stabilizing means may include a ground shoe located in the vicinity of the lower end of the ways assembly for frictionally engaging the ground.

DETAILED DESCRIPTION WITH REFERENCE TO THE DRAWINGS

Figure 1:
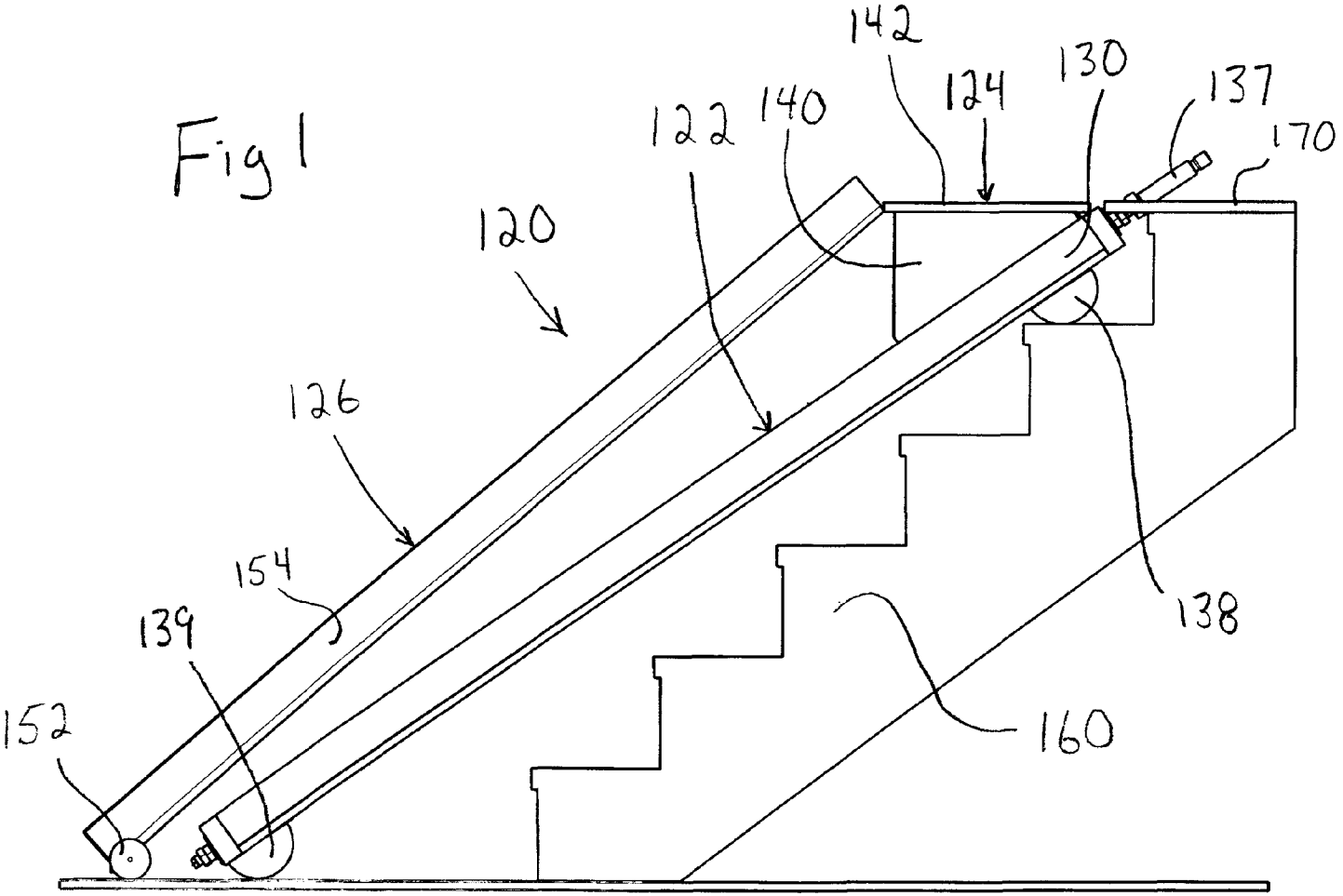
FIG. 1 is a side elevation view of a wheelchair-lift assembly embodiment of the present invention, referred to herein at times as a carriage embodiment, shown installed on a set of stairs, with the carriage at the top position, being the position suitable for accepting or releasing a wheelchair at the top of the set of stairs.

As shown in the drawings, embodiments of the present invention include a carriage-type embodiment 120. The carriage-type embodiment 120 has a ways assembly 122, carriage 124 and debarkation ramp 126.

Figure 2:
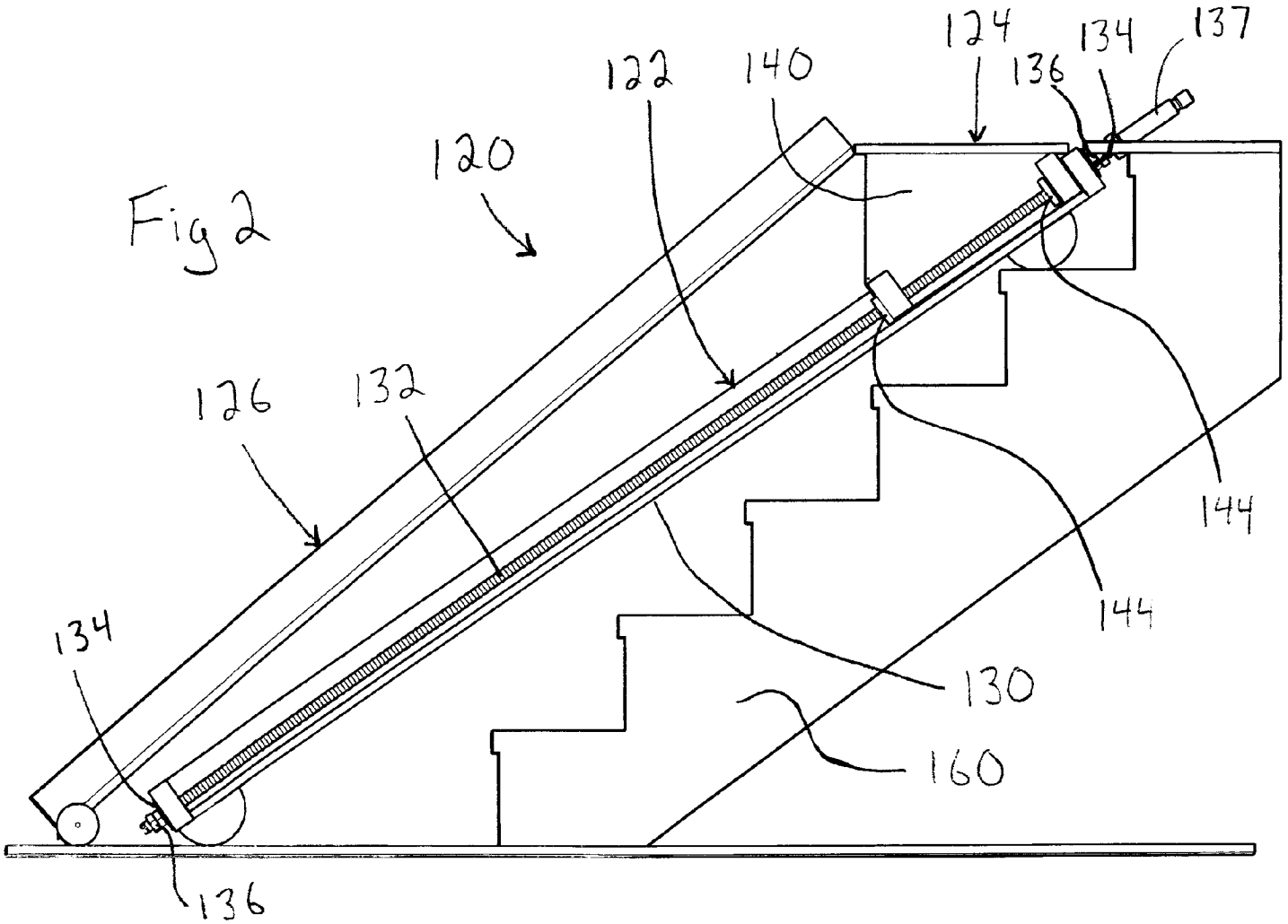
FIG. 2 is a side elevation partially cut-away view of the carriage-type embodiment shown in FIG. 1, shown with the carriage at the top position.
Figure 3:
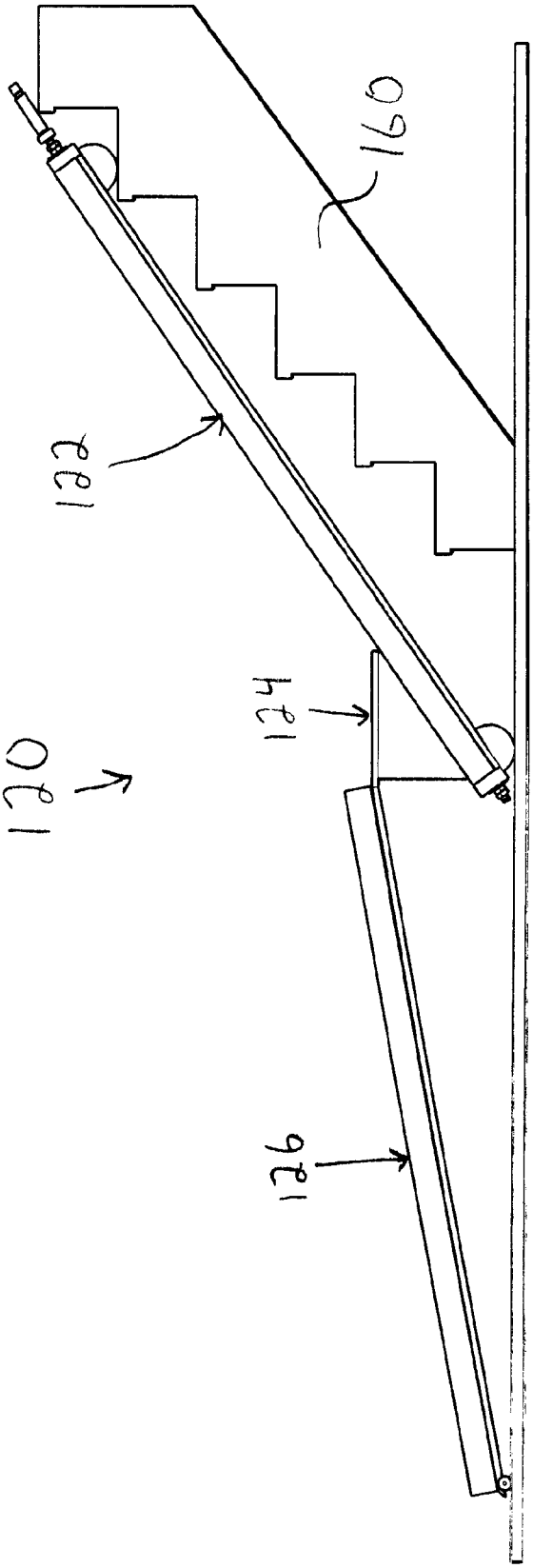
FIG. 3 is a side elevation view of the carriage-type embodiment shown in FIG. 1, shown with the carriage at the bottom position, being the position suitable for accepting a wheelchair from, or releasing a wheelchair to, the surface adjacent the lower end of the set of stairs.
Figure 4:
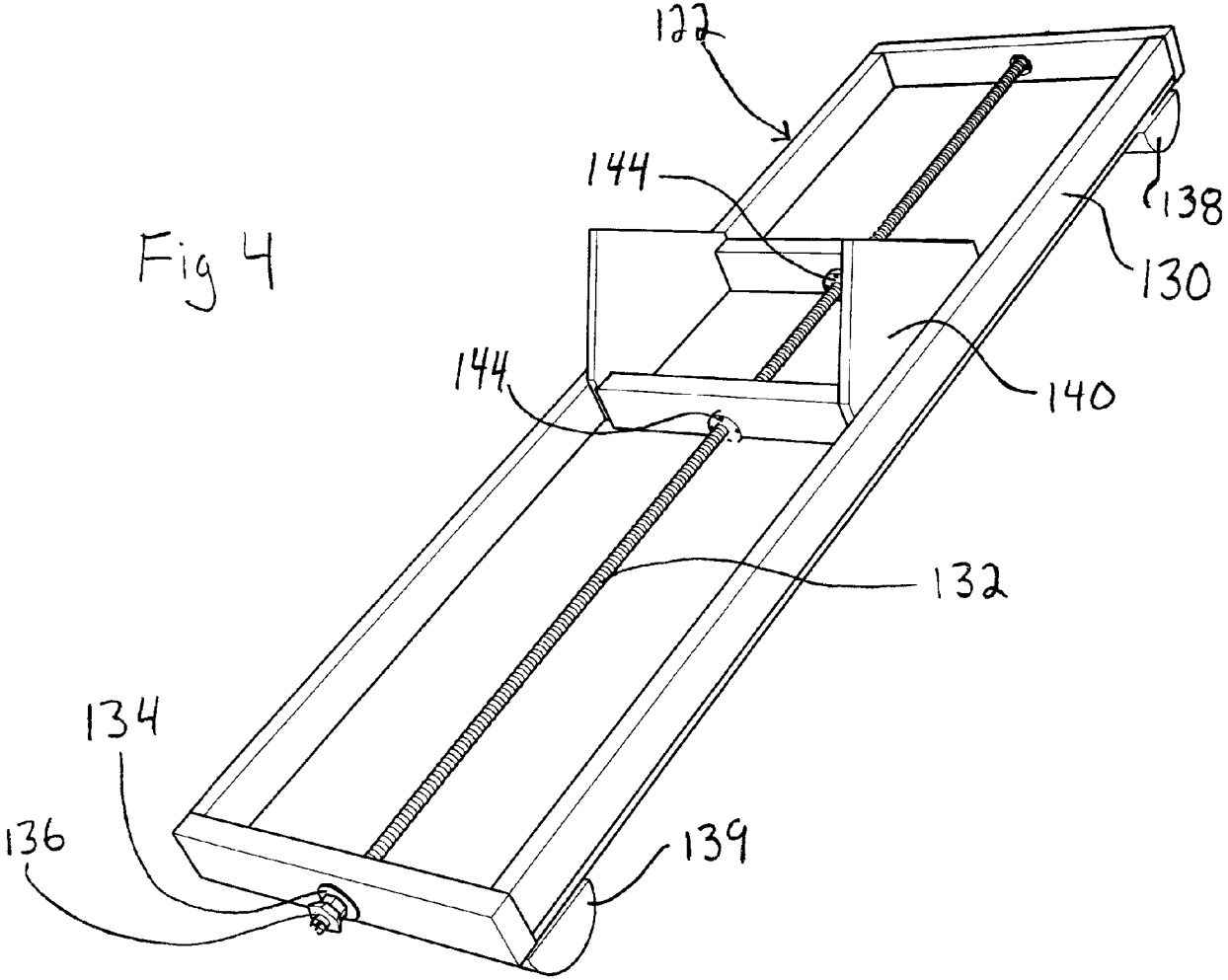
FIG. 4 is a partially cut-away perspective view of the carriage and ways assembly of the carriage-type embodiment shown in FIG. 1.
Figure 5:
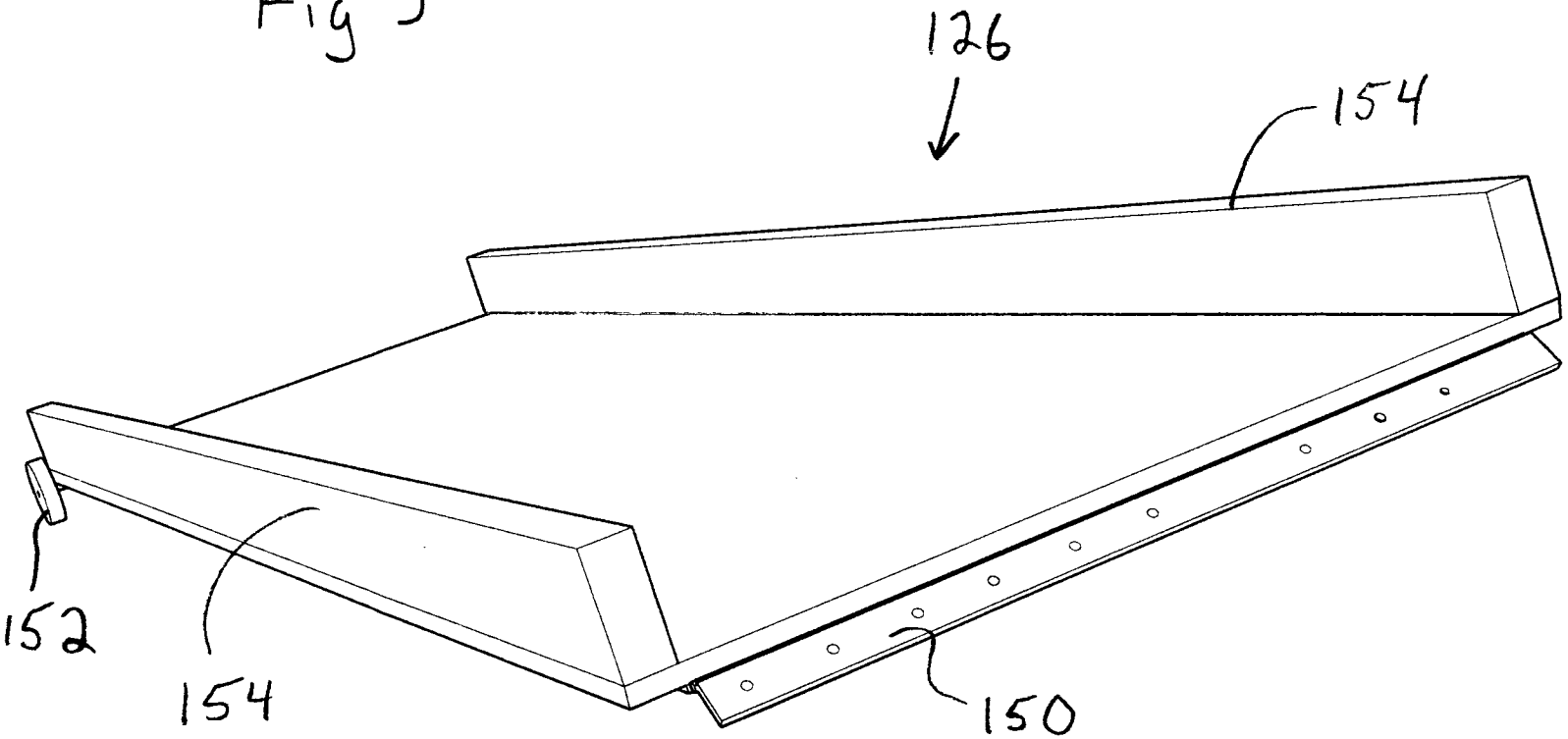
FIG. 5 is a perspective view from the proximal end of the ramp of the carriage-type embodiment of FIG. 1, with the ramp shown detached from the carriage.
Figure 6:
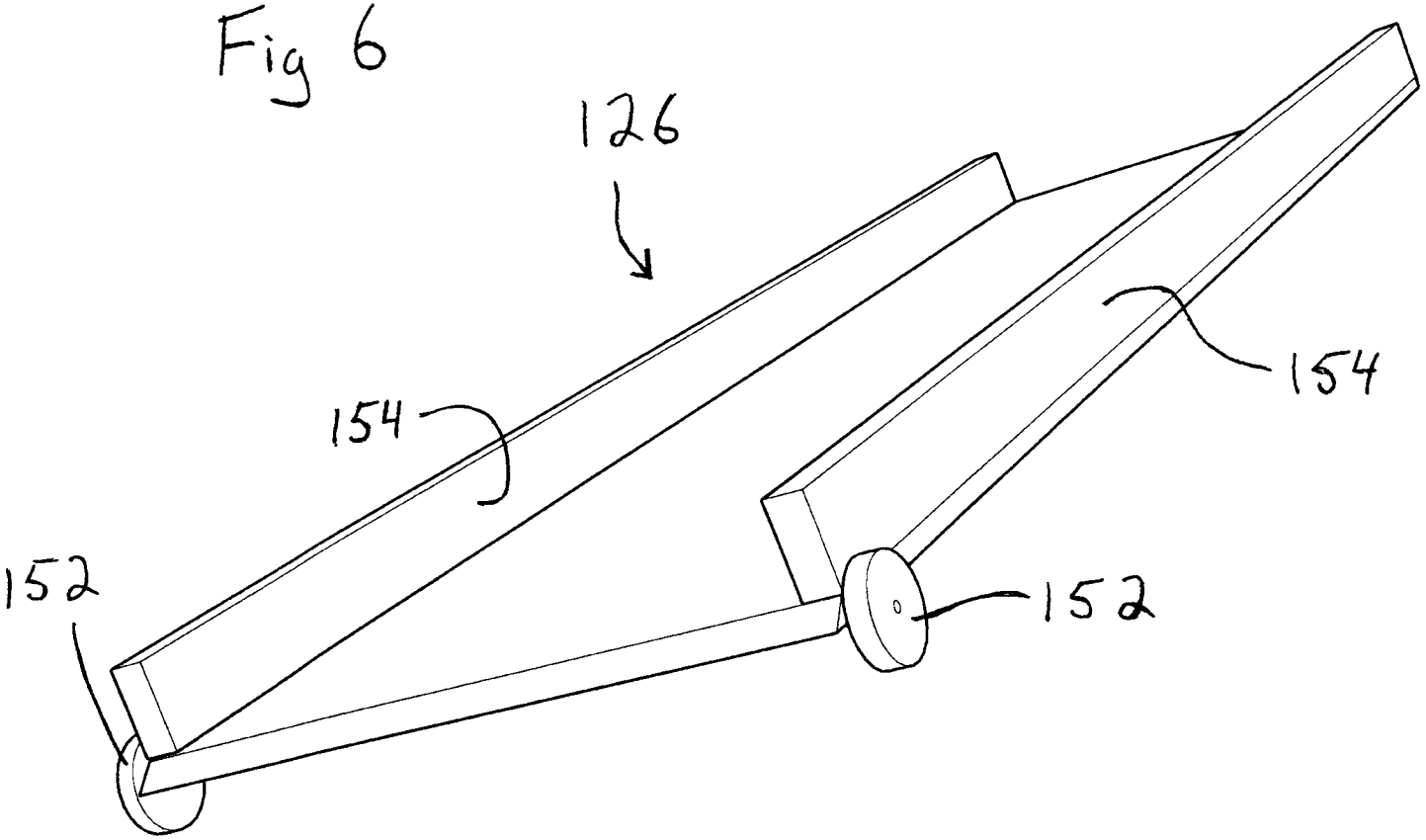
FIG. 6 is a perspective view from the distal end of the ramp of the carriage-type embodiment of FIG. 1, with the ramp shown detached from the carriage.
Figure 7A:
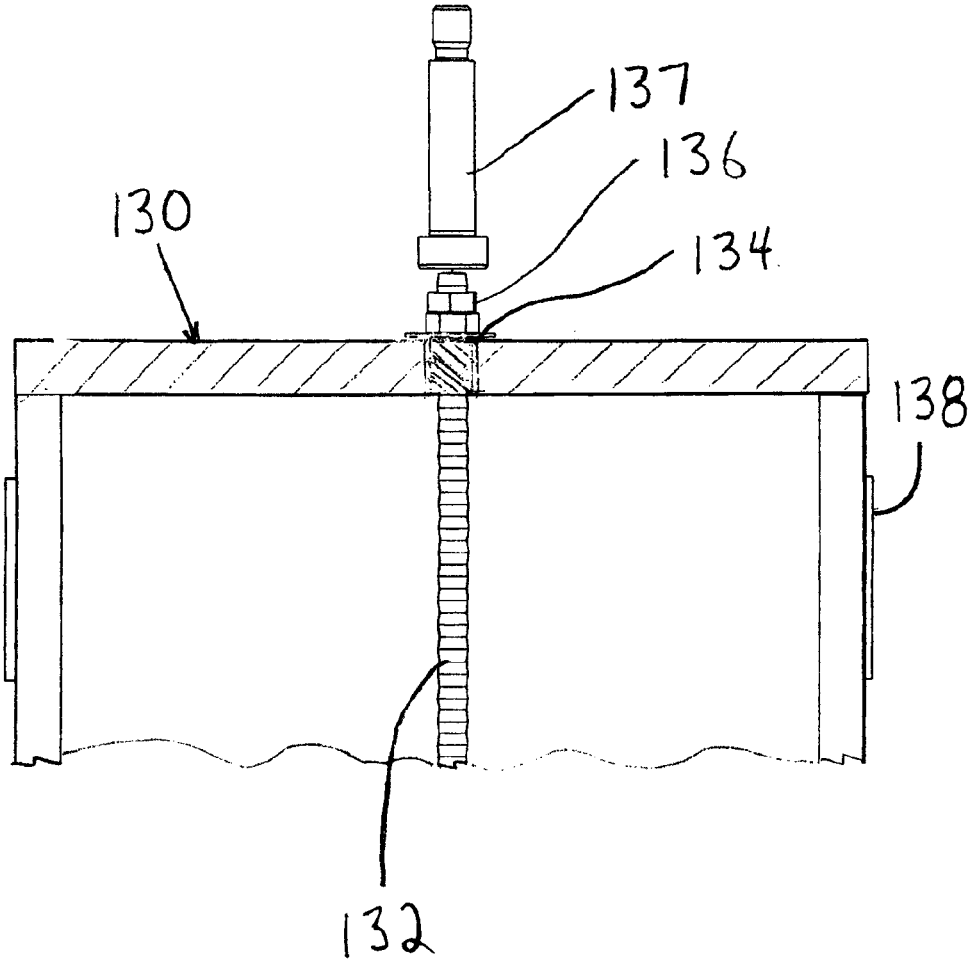
FIG. 7A is a partially sectional isolation view from perpendicular to the general plane defined by the ways assembly, of the upper end of the ways assembly of the carriage-type embodiment shown in FIG. 1.
Figure 7B:
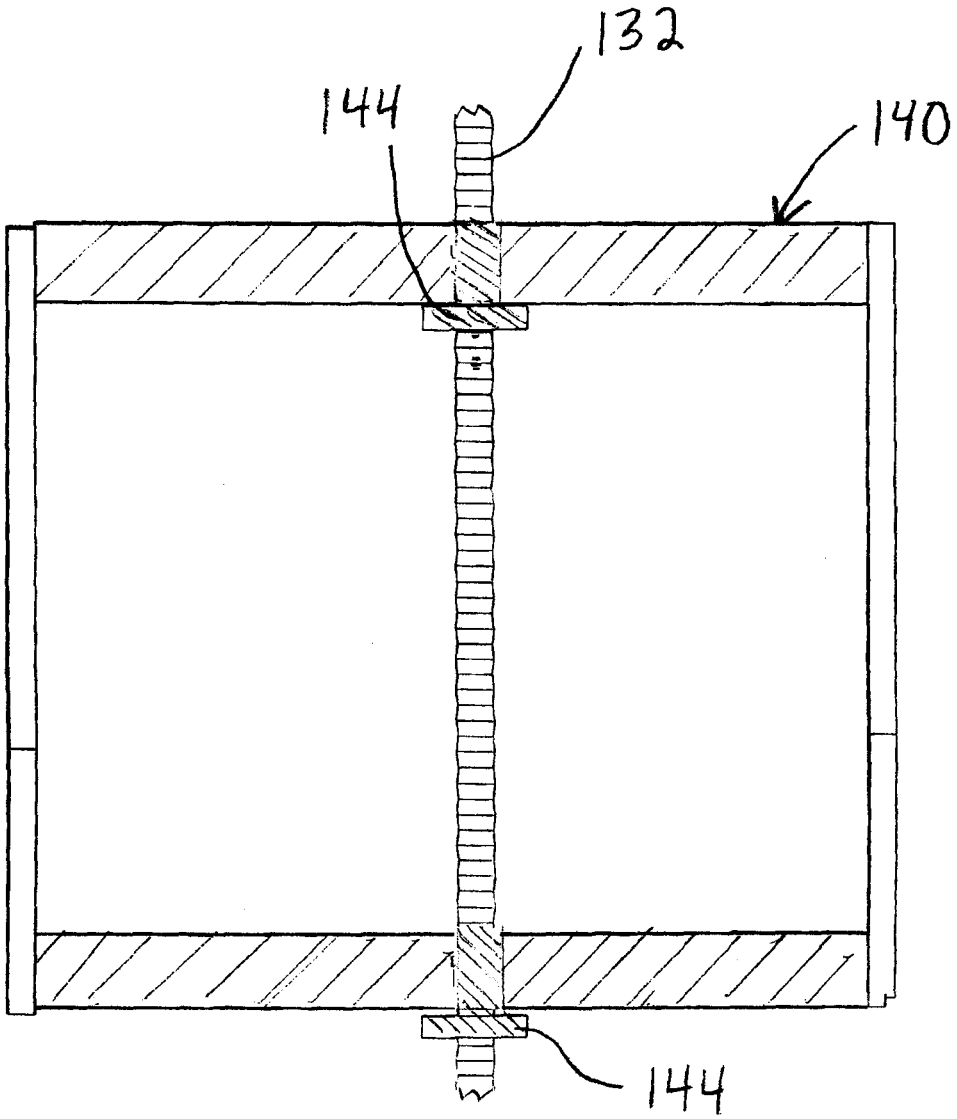
FIG. 7B is a partially sectional isolation view from perpendicular to the general plane defined by the ways assembly, showing features of the interior of the carriage, of the carriage-type embodiment shown in FIG. 1.
Figure 7C:
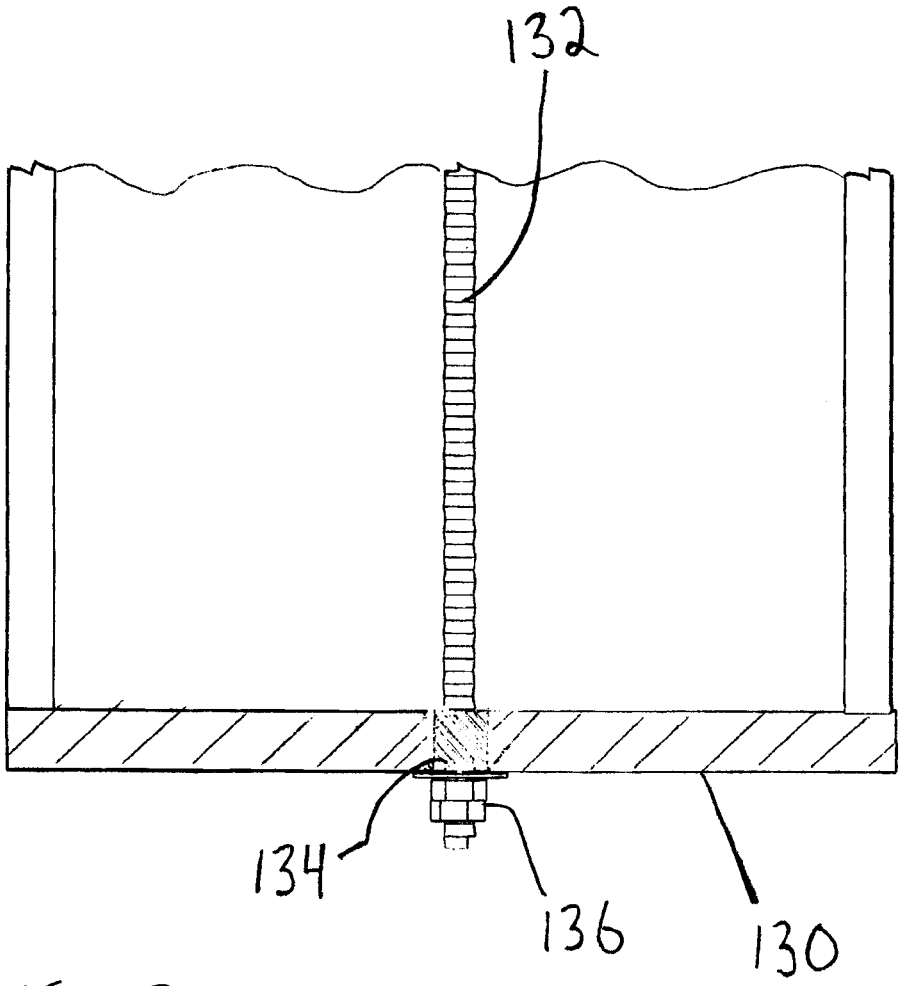
FIG. 7C is a partially sectional isolation view from perpendicular to the general plane defined by the ways assembly, of the lower end of the ways assembly of the carriage-type embodiment shown in FIG. 1.

The ways assembly 122 includes a ways 130, rotatable coil rod 132 (i.e., a threaded rod), and associated with each end of the coil rod 132, a thrust bearing 134 and engaging nut 136. As shown in FIGS. 1-3, a socket extension 137 may be removably fitted to the upper engaging nut 136 for rotating he coil rod 132 (described in further detail below).

The ways assembly 122 includes a stair foot 138 and a ground foot 139. The stair foot 138 and the ground foot 139 are preferably made from a material having a relatively high-friction surface so as to frictionally engage the stairs and ground respectively. The position of the stair foot 138 along the length of the ways assembly 122 is preferably adjustable by the user/installer so as to accommodate differences in step height and stair pitch.

The carriage 124 includes a carriage frame 140, a carriage frame platform 142 (for supporting a wheelchair) and two traveling nuts 144. The traveling nuts 144 are fixed relative to the carriage frame 140 and the coil rod 132 is threaded through both traveling nuts 144 such that rotation of the coil rod 132 causes the carriage 124 to move along the length of the coil rod 132.

The ramp 126 has at its proximal end a piano hinge 150 that it in use is affixed to the carriage 124 so as to provide hinged relative movement as between the carriage 124 and ramp 126. The ramp 126 has at its distal end wheels 152 (possibly casters or alternatively, low-friction sliders) for traversing the surface adjacent the bottom of the stairs when the carriage-type embodiment 120 is in use. The wheels 152 permit the distal end of the ramp 126 to accommodate uneven and variable terrain that may be a permanent feature or may result from transitory ice or snow.

Preferably, the ramp 126 has side rails 154 to assist in guiding wheelchair movement along the ramp 126. In the figures, some representations of the ramp 126 have side rails 154 and others do not.

As shown in the drawings, the carriage-type embodiment 120 may be installed on a set of stairs 160. As shown in FIGS. 1 and 2, in some installations, it may be desirable or necessary to include a bridge 170 to span the gap between the landing at the top of the stairs and the platform 142.

When installed, the carriage 124 is moveable through rotation of the coil rod 132 between a top position, being the position suitable for accepting or releasing a wheelchair at the top of the set of stairs, in which the ramp 126 essentially overlies the ways assembly 122, and a bottom position, in which the ramp 126 projects from the carriage 124 so as to be in a position suitable for traverse by a wheelchair between the surface adjacent the lower end of the set of stairs 160 and the carriage frame platform 142.

Figure 21:
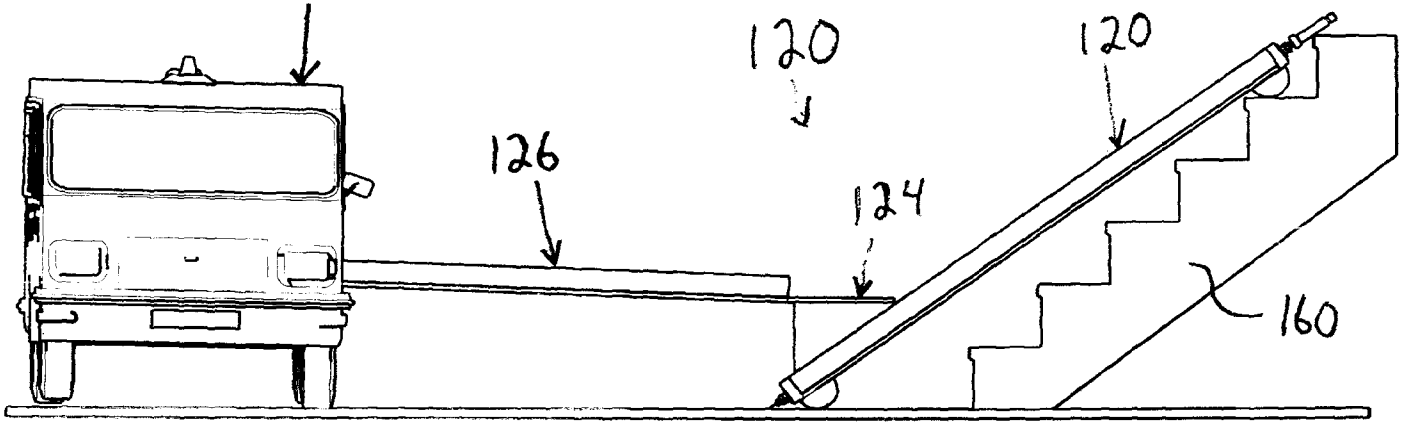
FIG. 21 is a side elevation view of the carriage-type embodiment shown in use with a vehicle.

In use, with the carriage 124 in the bottom position, the distal end of the ramp 126 may also be positioned elsewhere than on the surface adjacent the bottom of the stairs 160. As shown in FIG. 21, the distal end of the ramp 126 may be positioned in the entry way of a vehicle 180 so as to facilitate direct wheelchair travel between carriage frame platform 142 and the vehicle 180. This positioning of the ramp 126 may be obtained by pre-positioning the vehicle 180 and raising the distal end of the ramp 126 as the carriage 124 is moved towards the bottom position, either manually or by means of a track or tracks for guiding the distal end of the ramp 126 into the desired position. Alternatively, the ramp 126 may be configured to be extendible such that the ramp 126 may be lifted and extended to bring the distal end of the ramp 126 into engagement with the vehicle entryway with the carriage 124 in the bottom position.

In many situations, the carriage-type embodiment 120 may be installed without being fastened to the stairs. The carriage-type embodiment 120 clears the steps from the top tread to the lower landing without any fastening.

The carriage-type embodiment 120 may be configured to accommodate different stair pitches by configuring the carriage 124 such that the angle of the carriage frame platform 142 relative to the carriage frame 140 may be adjusted.

Figure 8:
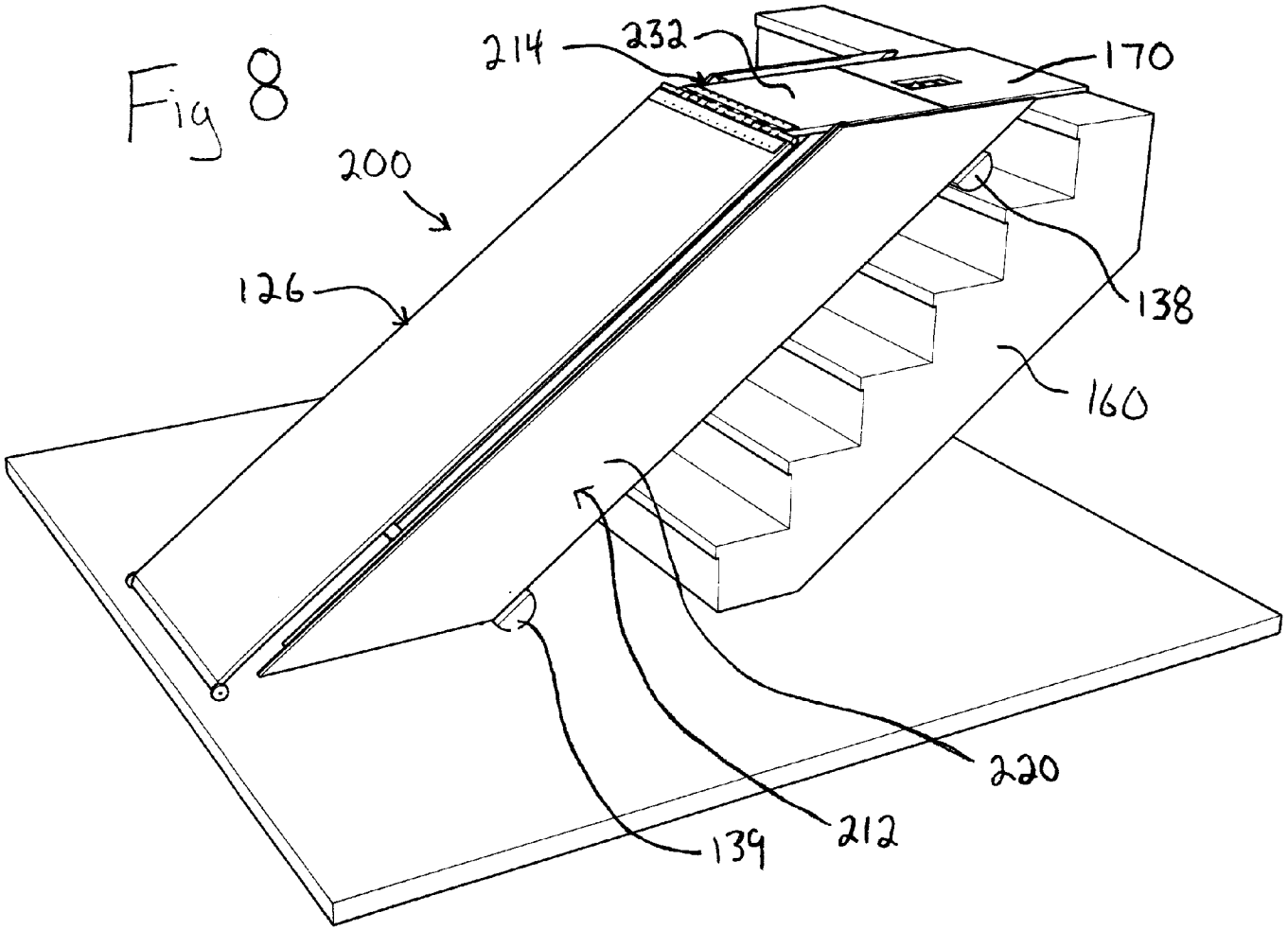
FIG. 8 is a perspective view of another embodiment of the present invention, referred to herein at times as a side-channel embodiment, shown installed on a set of stairs, with the plate at the top position, being the position suitable for receiving a wheelchair from, or delivering a wheelchair to, the top of the set of stairs.
Figure 9:
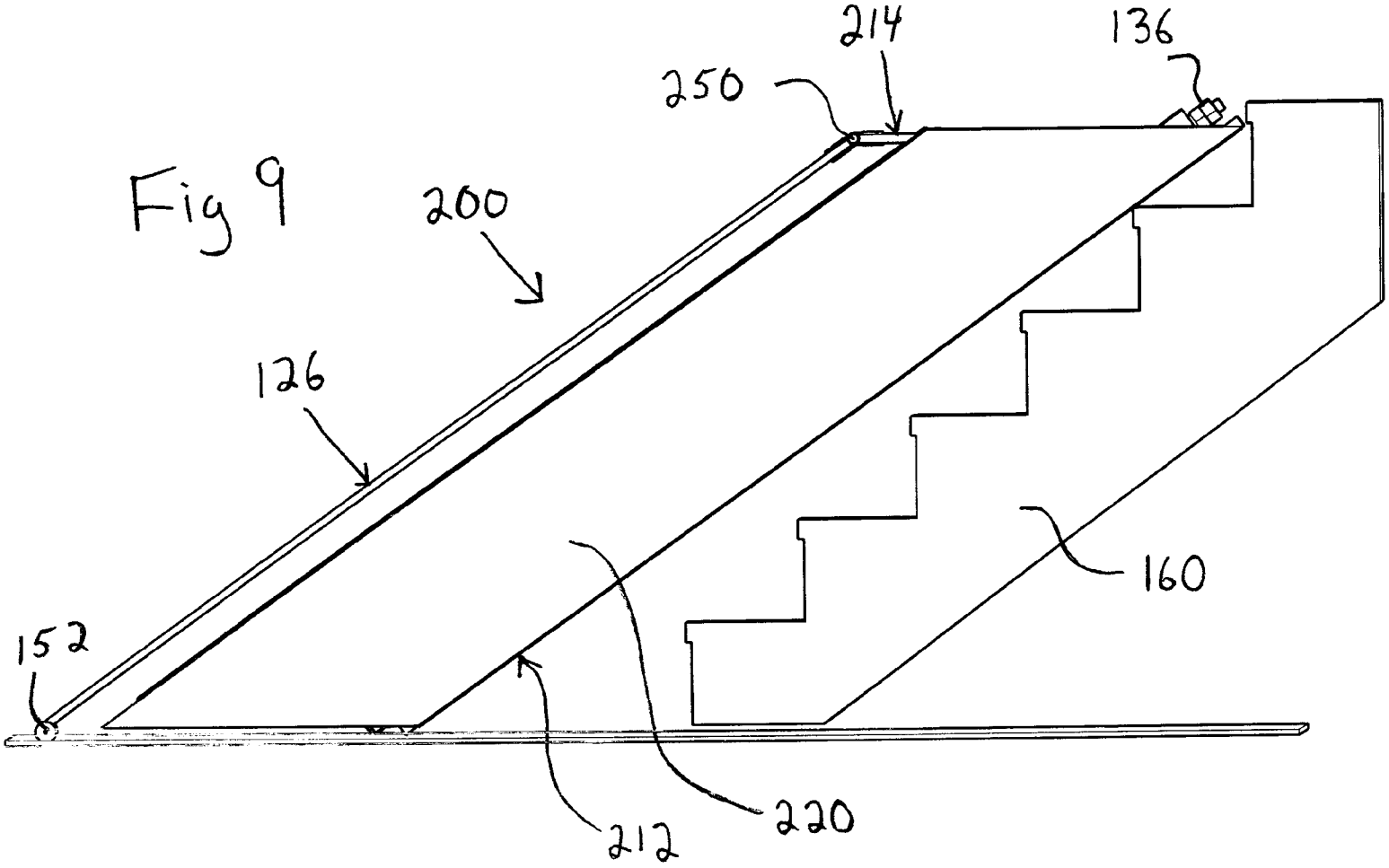
FIG. 9 is a side elevation simplified view of a side-channel embodiment shown with the plate in the top position.
Figure 10:
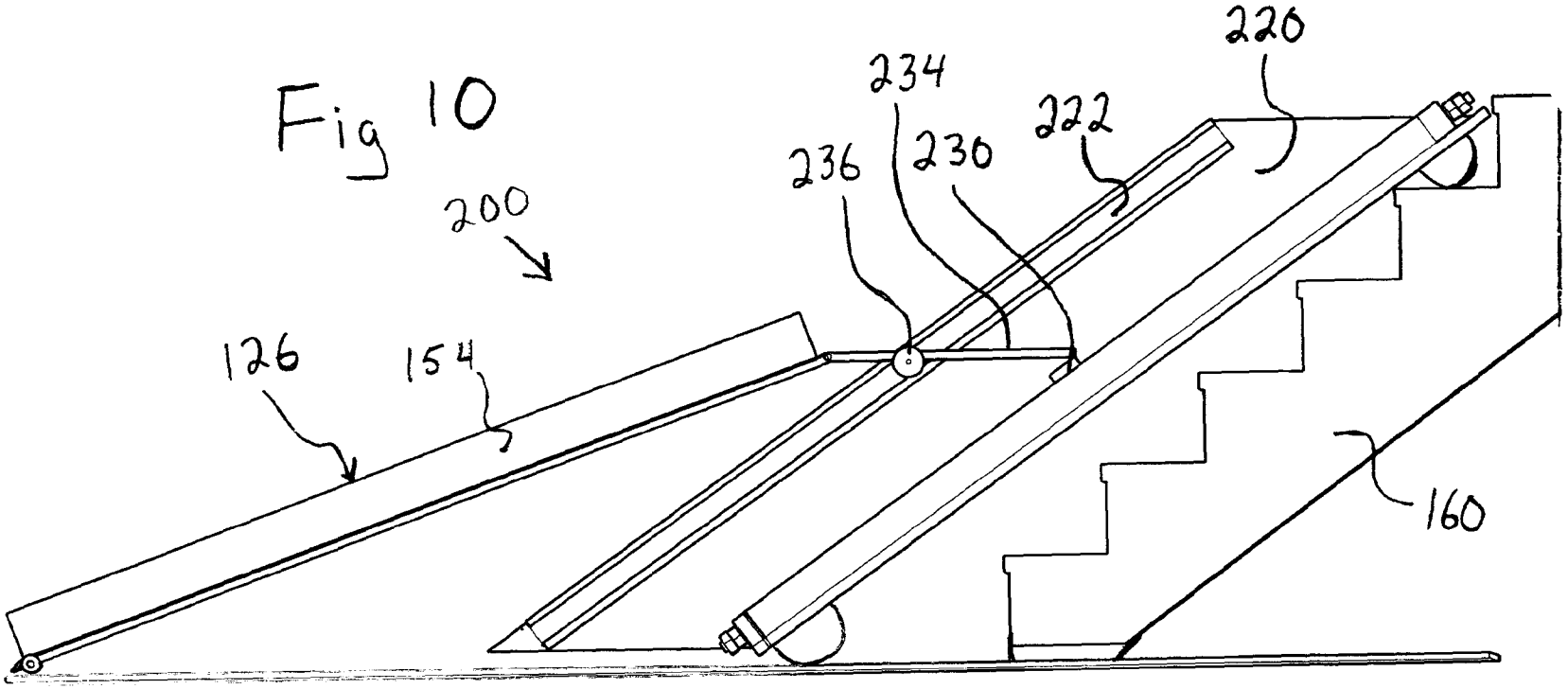
FIG. 10 is a side elevation simplified cutaway view of a side-channel embodiment shown with the plate an intermediate position.
Figure 11:
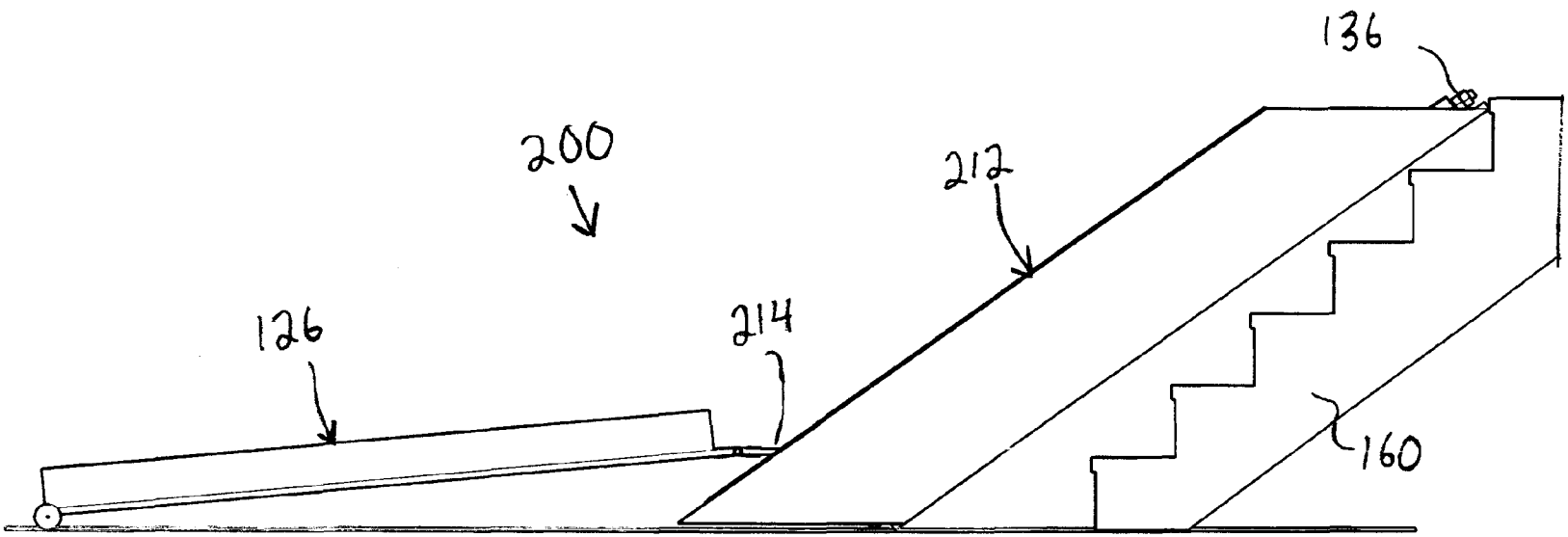
FIG. 11 is a side elevation simplified view of a side-channel embodiment shown with the plate in the bottom position being the position suitable for receiving a wheelchair from, or delivering a wheelchair to, the surface adjacent the lower end of the set of stairs.
Figure 12:
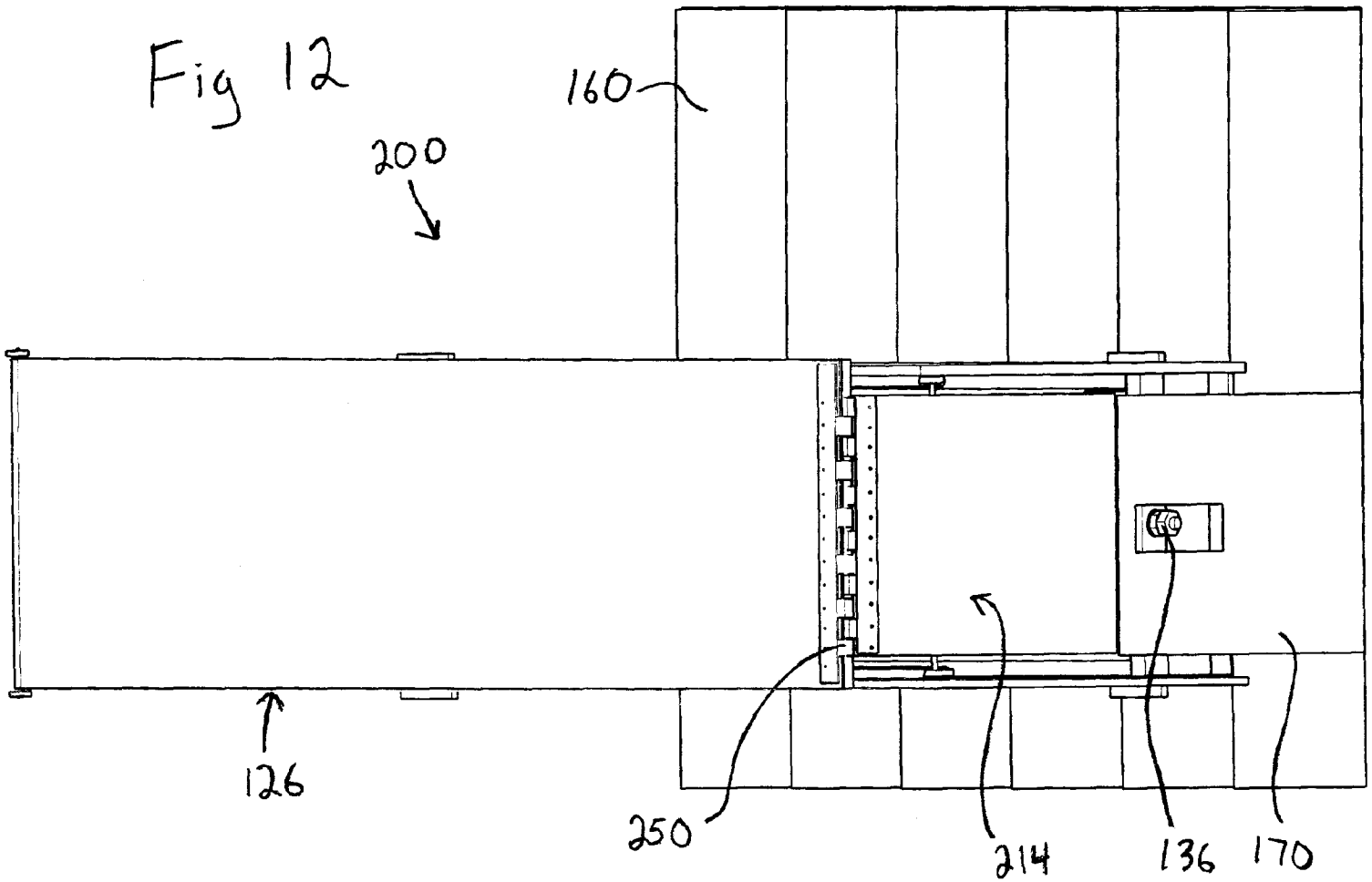
FIG. 12 is a top plan view of a side-channel embodiment shown in FIG. 8 in the top position.
Figure 13:
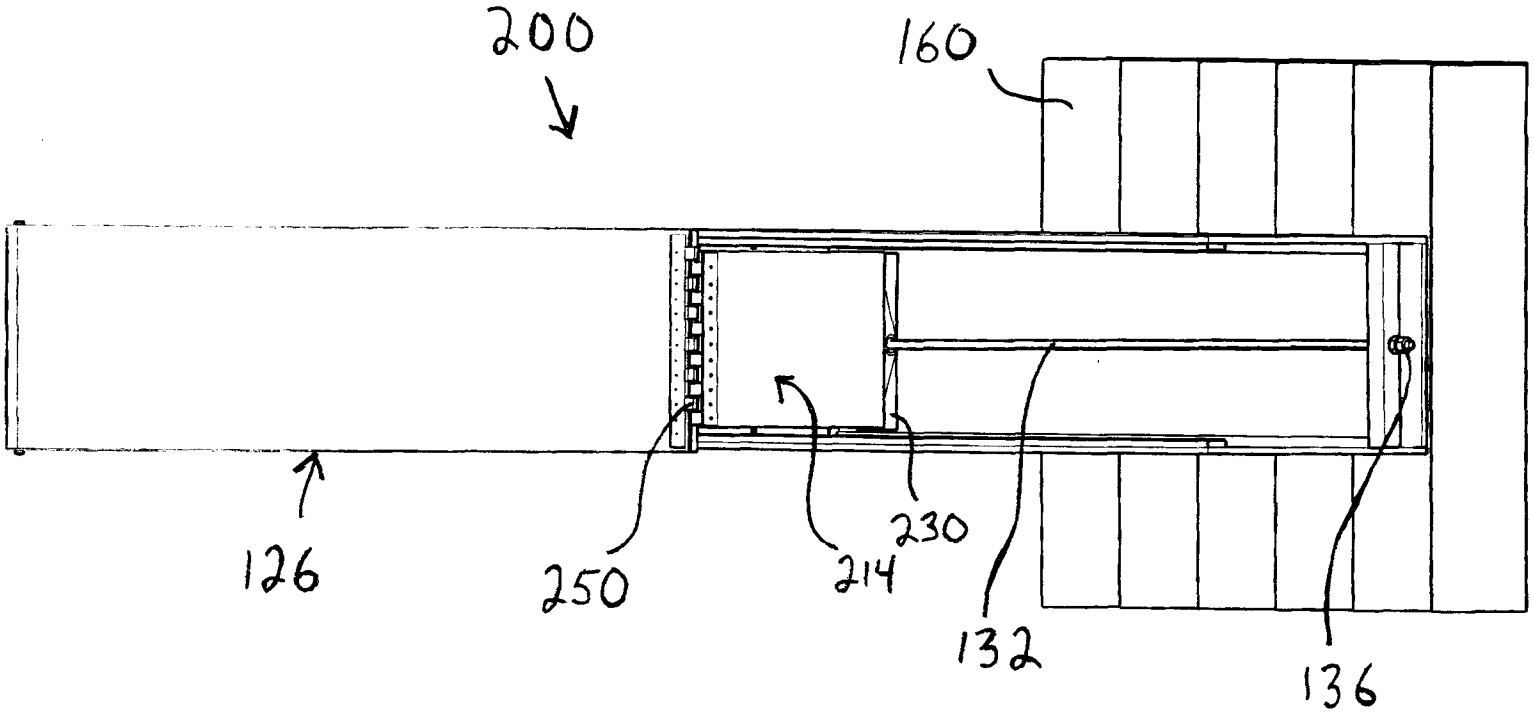
FIG. 13 is a top plan simplified view of a side-channel embodiment in the bottom position.
Figure 14:
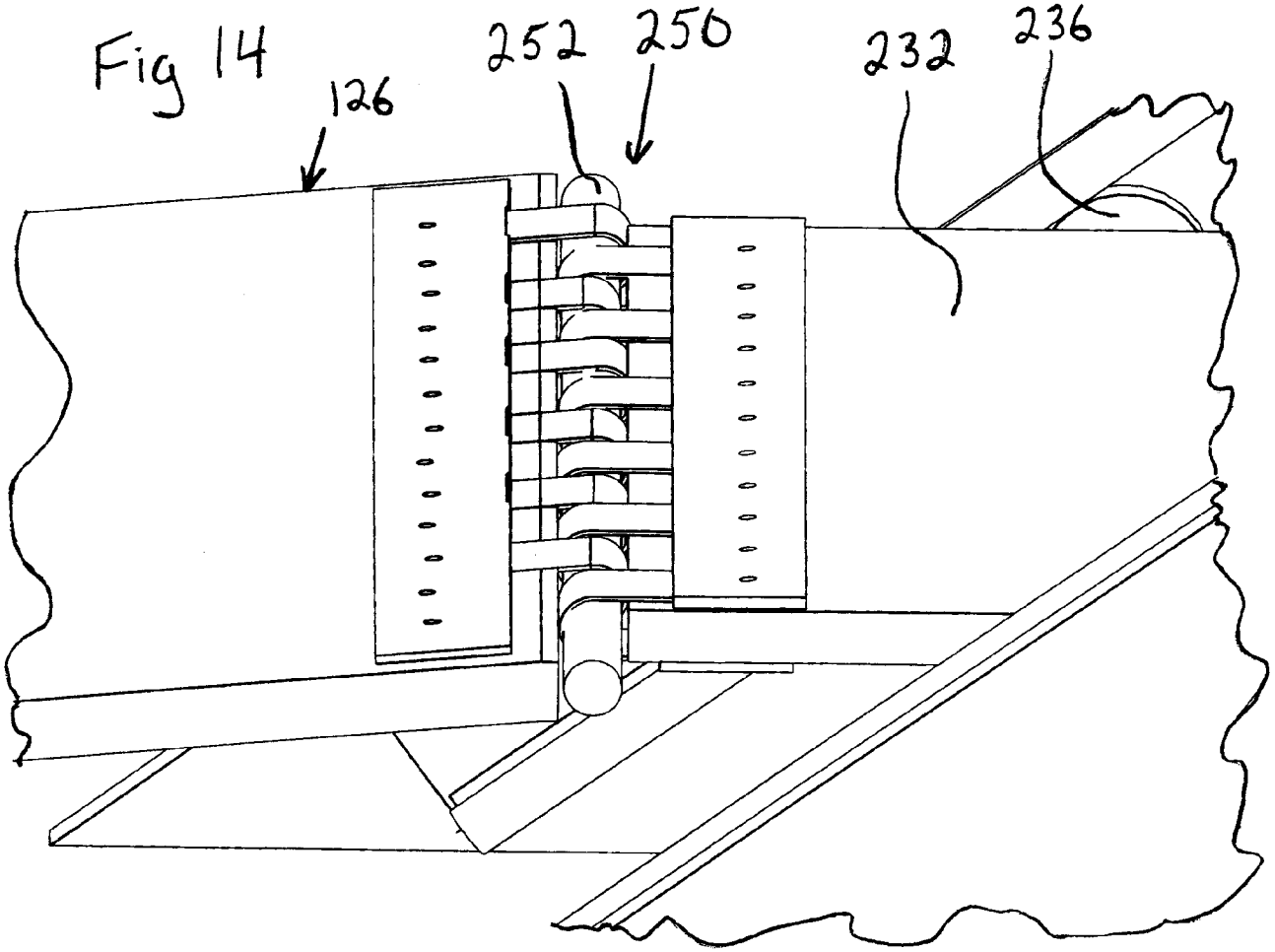
FIG. 14 is a perspective isolation view showing details of the plate, plate hinge and adjacent features of a side-channel embodiment.

A side-channel embodiment 200 is shown in FIG. 8 and following figures. The side-channel embodiment 200 has a side-channel ways assembly 212, a plate assembly 214 and a debarkation ramp 126.

The side-channel ways assembly 212 includes a ways 130, rotatable coil rod 132, and associated with each end of the coil rod 132, a thrust bearing 134 and engaging nut 136. Attached to each side of the ways 130 is a sidewall 220. Each sidewall 220 has a channel 222 extending along the length of the sidewall 220. The side-channel ways assembly 212 preferably includes a stair foot 138 and ground foot 139.

Figure 15:
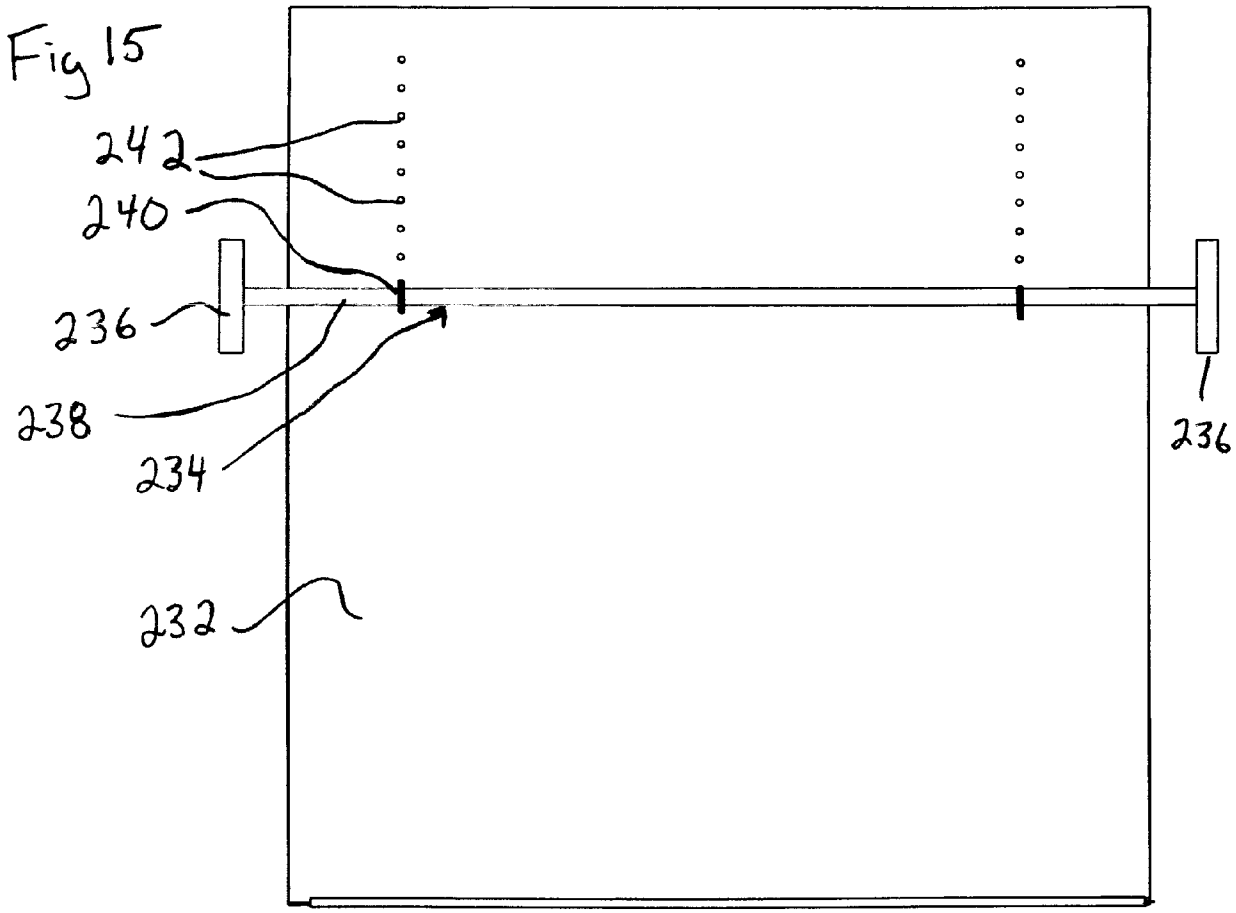
FIG. 15 is a bottom plan simplified view of the plate, axle and rollers of a side-channel embodiment.

The plate assembly 214 includes a traveling member 230 having a traveling nut 144 affixed thereto and with the traveling nut 144 in threaded engagement with the coil rod 132. Attached to the traveling member 230, there is a plate 232. Attached to the plate 232 there is a roller assembly 234 comprising two rollers 236 and a roller axle 238. As shown in FIG. 15 the roller axle 238 is affixed to the bottom of the plate 232 by way of U-fasteners 240 installed in roller mounting holes 242. There are multiple roller mounting holes 242 and thus the position of the roller assembly 234 may be adjusted by installing the U-fasteners 240 in the desired roller mounting holes 242 (for example, so as to accommodate differences in pitch).

Each roller 236 engages the interior of, and is thereby supported by, a respective channel 222.

The ramp 126 is attached to the distal edge of the plate 232 by way of a pin hinge 250. The pin 252 of the pin hinge 250 may be removed and reinserted, thus permitting easy separation of the plate 232 and ramp 126, such as for maintenance or adjustment of the side-channel embodiment 200.

As compared to the carriage-type embodiment 120, the side-channel embodiment 200 tends to provide a less-steep slope when the ramp 126 is in use as a wheelchair pathway, in that, when the plate assembly 214 is in the bottom position, the wheelchair is closer to the ground than when the carriage 124 is in the bottom position.

Figure 16:
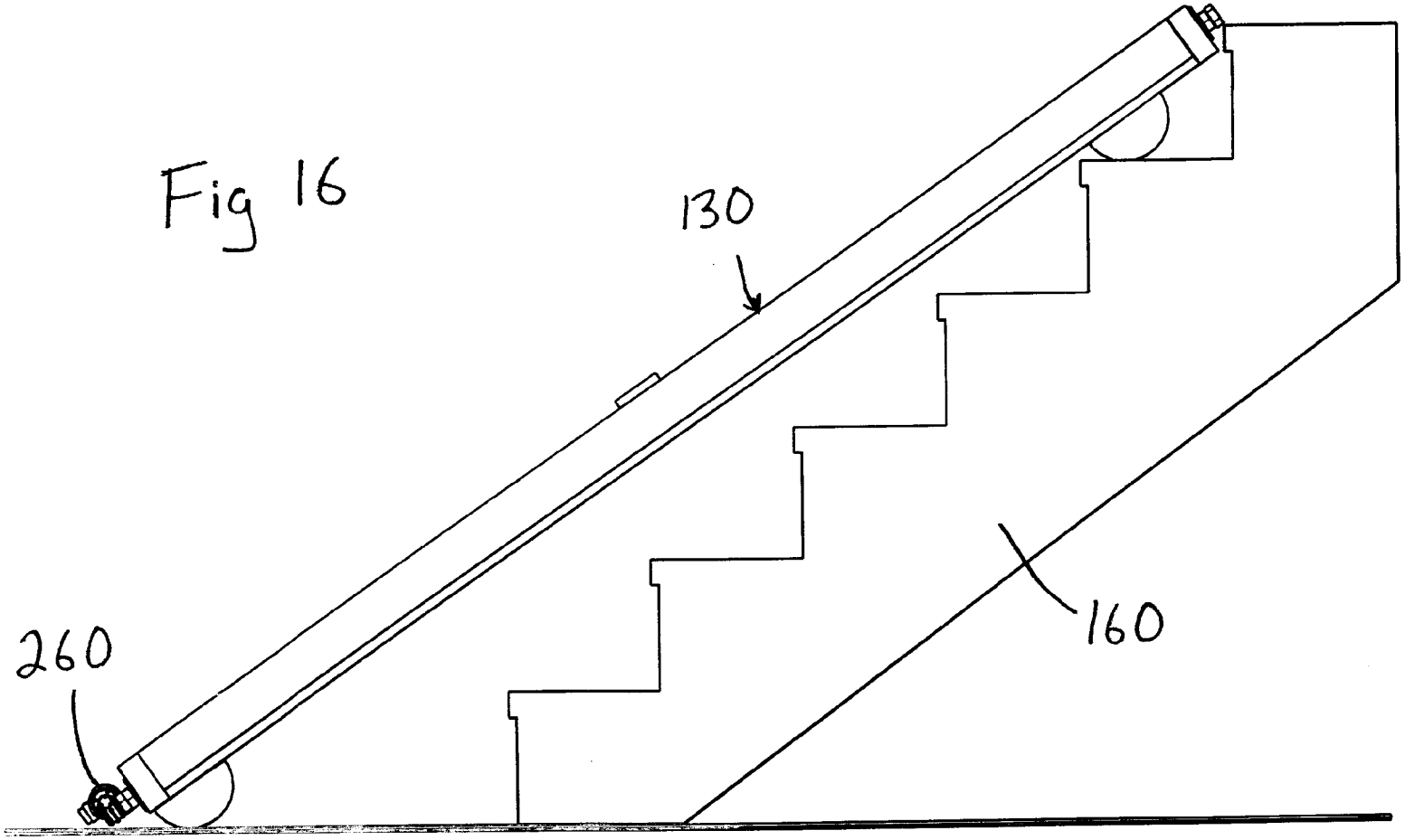
FIG. 16 is a side elevation simplified cutaway view of an embodiment having a drive motor.

As shown in FIG. 16, a drive motor 260 may be mounted to the ways 130 in permanent drive engagement with the coil rod 132. A drive motor 260 may be controlled by a mounted switch (not shown) if control is to be by a person assisting a person in a wheelchair, or by a remote radio device (not shown), if control is to be by a person in a wheelchair or by a person assisting a person in a wheelchair. Preferably, an embodiment with a drive motor 260 would have automatic cut-off switches (not shown) to stop the drive motor 260 once the top position or bottom position (as the case may be) has been achieved.

Figure 17:
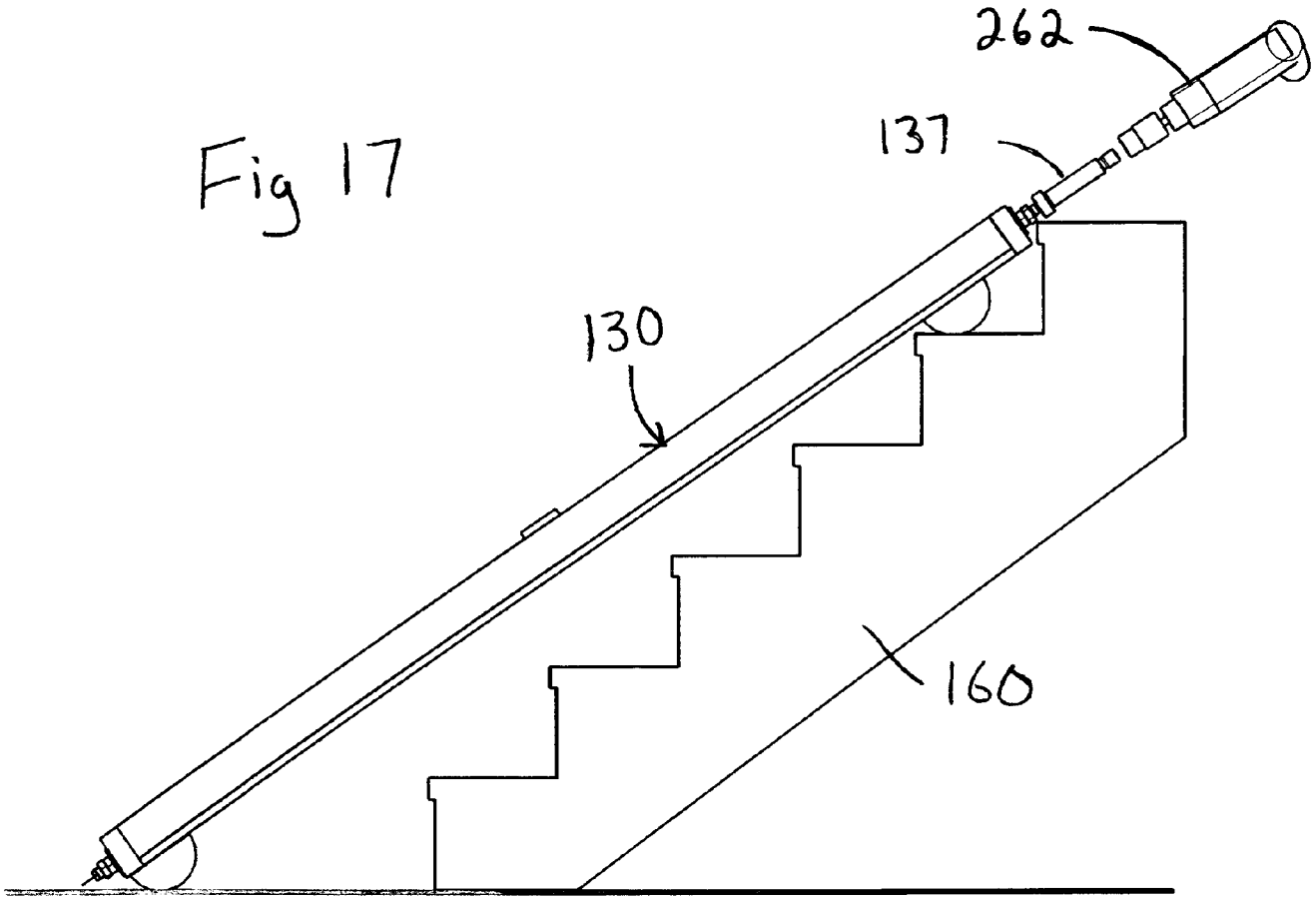
FIG. 17 is a side elevation simplified cutaway view of an embodiment showing a socket extension and power drill aligned for use in moving the plate.
Figure 18:
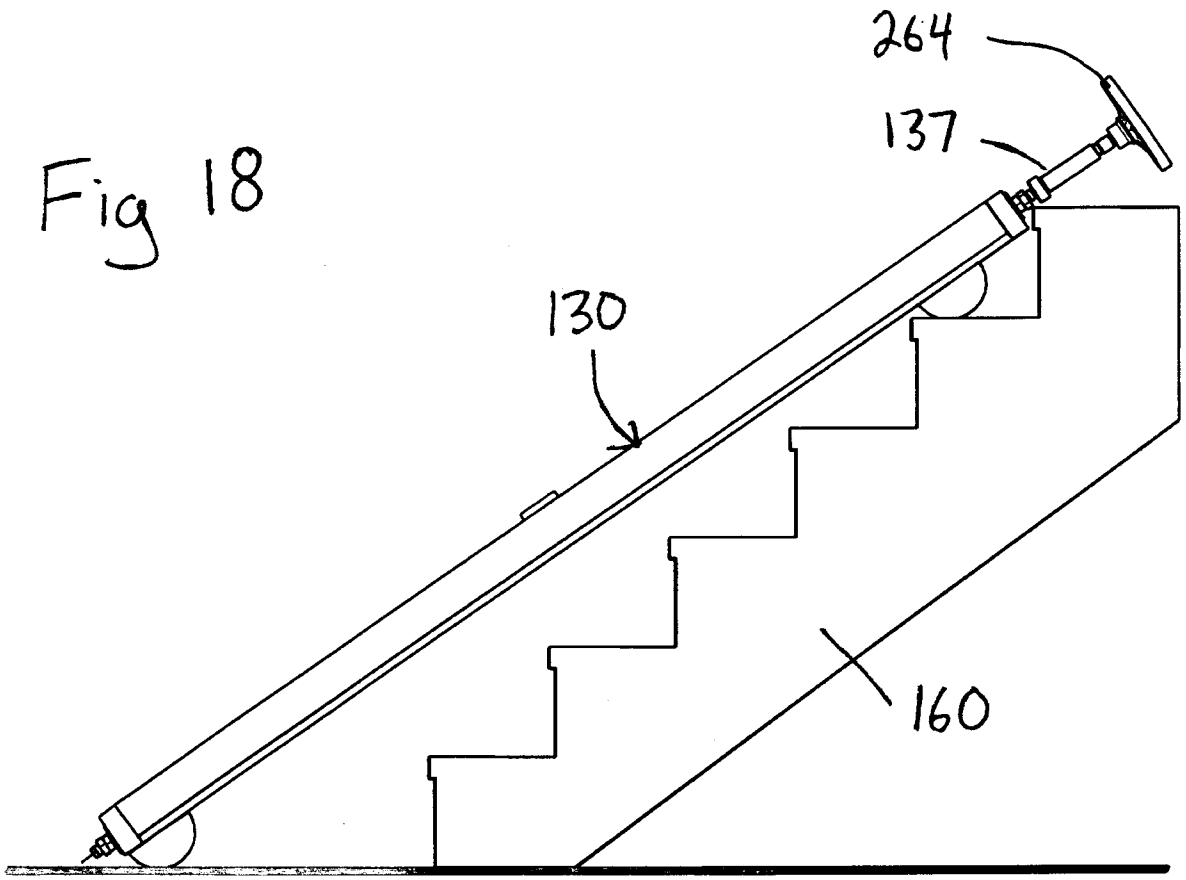
FIG. 18 is a side elevation simplified cutaway view of an embodiment showing a socket extension and hand wheel in position for use in moving the plate.
Figure 19:
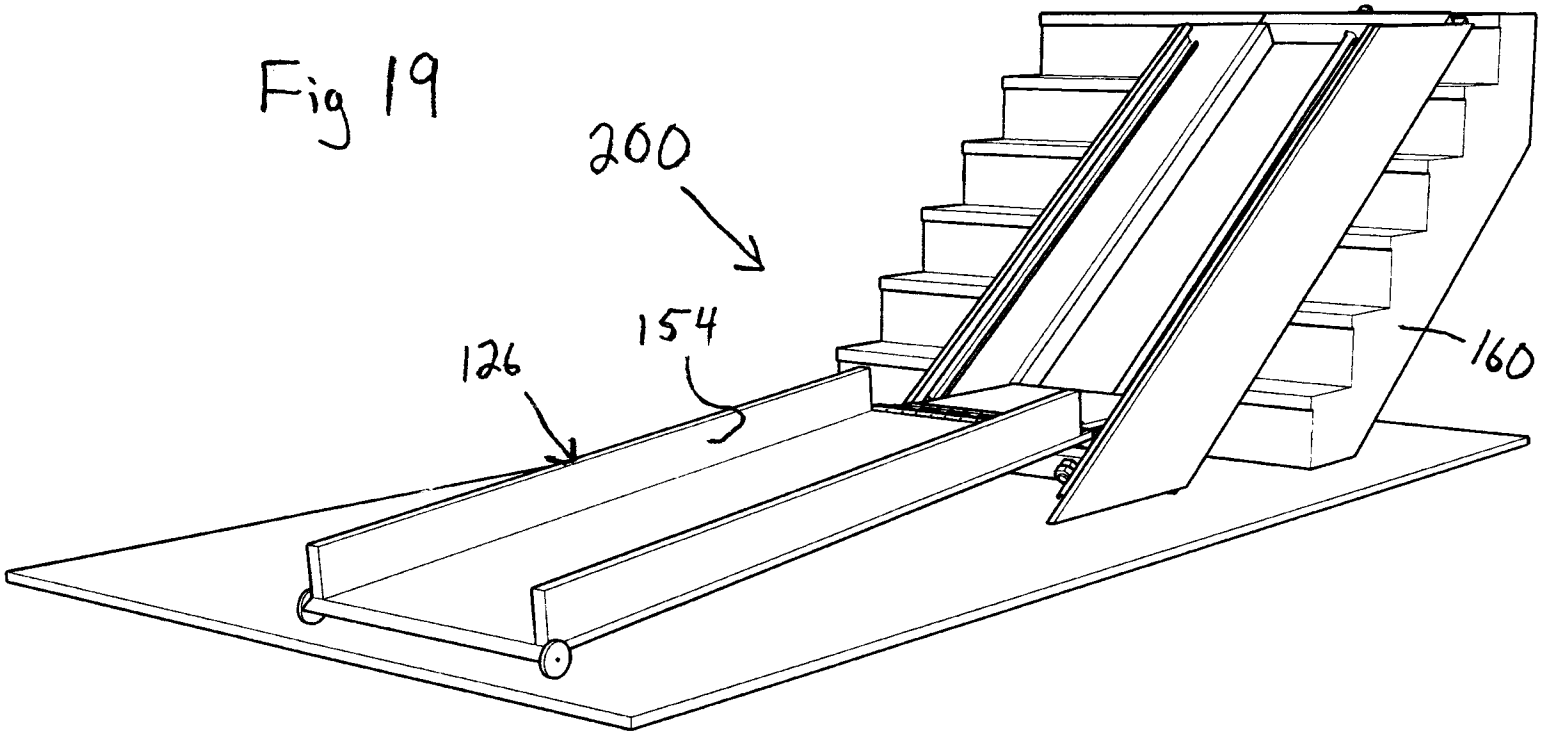
FIG. 19 is a perspective view of a side-channel embodiment having side rails on the debarkation ramp shown with the plate in the bottom position.
Figure 20:
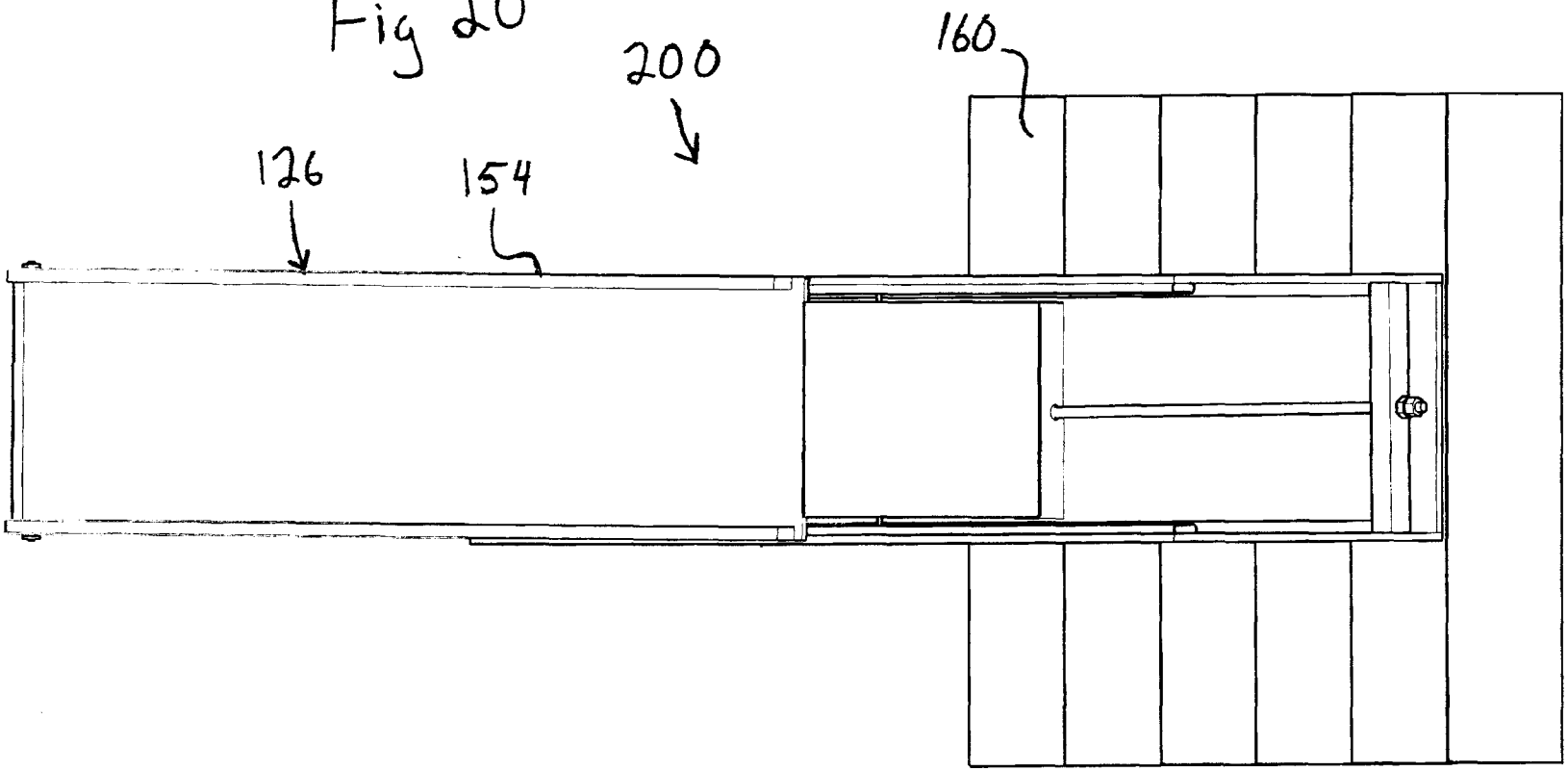
FIG. 20 is a top plan view of the embodiment shown in FIG. 19 showing the plate in the bottom position.

As shown in FIG. 17, the socket extension 137 may be used with a conventional two-direction power drill 262 to rotate the coil rod 132 as required. Alternatively or as a fall back in the event of a power failure, as shown in FIG. 18 the socket extension 137 may be used with a hand wheel 264 to rotate the coil rod 132 as required.

Various forms of lead screw assemblies and nut combinations (i.e., coil rods and traveling nuts) are known and a designer would be able to readily select and obtain a suitable off-the-shelf combination.

What is claimed is:

1. An apparatus for use in transporting a wheelchair up or down stairs, the stairs including a top of the stairs, the apparatus comprising:

a longitudinally extending ways assembly, having a length, a lower end and an upper end;

a wheelchair platform supported by the ways assembly;

a motive arrangement for selectively moving the wheelchair platform along the length of the ways assembly between:

a top position, in which a wheelchair may move substantially directly from the wheelchair platform to the top of the stairs or may move substantially directly from the top of the stairs to the wheelchair platform; and a bottom position; and a ramp having a proximal end and a distal end, the proximal end hingedly attached to the wheelchair platform and the distal end having a ground engagement feature, wherein contact between the ground engagement feature and the ground, as the wheelchair platform moves towards the bottom position, causes the ramp to pivot away from the ways assembly so as to provide a wheelchair path of travel between the wheelchair platform and the ground when the wheelchair platform is in the bottom position, and movement of the wheelchair platform towards the top position permits the ramp to pivot towards the ways assembly.

2. The apparatus of claim 1 wherein the motive arrangement comprises a threaded rod rotatably mounted to the ways assembly and a primary traveling nut threadedly engaging the threaded rod attached to a traveling member, wherein rotation of the threaded rod causes the traveling member to move along the length of the ways assembly.

3. The apparatus of claim 2, wherein the wheelchair platform comprises a carriage frame affixed to the traveling member.

4. The apparatus of claim 3, further comprising a secondary nut threadedly engaged with the threaded rod and affixed to the carriage frame in a spaced apart relationship from the primary traveling nut.

5. The apparatus of claim 2, further comprising a manual implement for removably connecting to an end of the threaded rod for manually rotating the threaded rod.

6. The apparatus of claim 5, wherein the manual implement is a hand wheel.

7. The apparatus of claim 2, wherein the ways assembly comprises two opposed side walls, wherein each side wall has a longitudinally extending channel; and wherein the wheelchair platform comprises: a plate having a proximal edge and a distal edge, wherein the plate is attached near the proximal edge to the traveling member and hingedly attached at the distal edge to the ramp; and two rollers, each roller engaging a respective one of the longitudinally extending channels, wherein the wheelchair platform is supported by the traveling member and the longitudinally extending channels.

8. The apparatus of claim 2, further comprising a motor attached to the threaded rod and configured for selectively reversibly rotating the threaded rod.

9. The apparatus of claim 2, further comprising a removeable adapter for connecting a hand-operated reversible power drill to an end of the threaded rod.

10. The apparatus of claim 1 further comprising means for stabilizing the apparatus at a desired position relative to the stairs.

11. The apparatus of claim 10, wherein the stabilizing means comprises a stair foot for fixing at a desired position interposed between the ways assembly and a tread of the stairs.

12. The apparatus of claim 10, wherein the stabilizing means comprises a ground shoe located near the lower end of the ways assembly for frictionally engaging the ground.

13. The apparatus of claim 1, wherein the ground engagement feature comprises two wheels spaced apart one from the other.

14. The apparatus of claim 1, wherein the ramp has side rails.

15. The apparatus of claim 1, wherein the ramp is hingedly attached to the wheelchair platform by a hinge having a reversibly retractable hinge pin whereby a user may detach the ramp from the wheelchair platform by manual withdrawal of the hinge pin and may attach the ramp to the wheelchair platform by manual insertion of the hinge pin.

* * * * *